US005474517A

United States Patent [19]

Falk et al.

[11] Patent Number: 5,474,517

[45] Date of Patent: Dec. 12, 1995

[54] HEATER ASSEMBLY FOR INFANT WARMERS

[75] Inventors: Steven M. Falk, Silver Spring; Michael H. Mackin, Ellicot City, both of Md.

[73] Assignee: Ohmeda Inc., Liberty Corner, N.J.

[21] Appl. No.: 290,643

[22] Filed: Aug. 15, 1994

[51] Int. Cl.[6] ..... A61G 11/00

[52] U.S. Cl. ..... 600/22

[58] Field of Search ..... 600/21, 22; 119/35, 119/37, 38, 39; 5/421

[56] References Cited

U.S. PATENT DOCUMENTS

| | | | |
|---|---|---|---|
| 4,312,331 | 1/1982 | Hahmann | 600/22 |
| 4,750,474 | 6/1988 | Dukhan et al. | 600/22 |
| 4,809,677 | 3/1989 | Mackin et al. | 600/22 |
| 5,162,038 | 11/1992 | Wilker | 600/22 |
| 5,308,310 | 5/1994 | Roff et al. | 600/21 |

*Primary Examiner*—Angela D. Sykes
*Assistant Examiner*—Samuel Gilbert
*Attorney, Agent, or Firm*—Roger M. Rathbun; Larry R. Cassett

[57] ABSTRACT

An infant care center or infant care warmer having as it source of heat, an infrared emitter that is located above the infant bed and which is relatively small in dimensions so as to not impede the access to the infant by attending personnel at any time, including when X-rays are being taken to the infant. The emitter is contained in a sealed emitter assembly and includes a lens that focuses and directs the infrared radiation to a desired footprint on the infant bed. In a specific embodiment, the infrared emitter is shaped generally in the form of a parabola and a honeycomb material comprising a plurality of hexagonal openings receives the infrared radiation from the parabolic shaped emitter and redirects the radiation into a desired pattern toward the infant bed.

9 Claims, 4 Drawing Sheets

FIG. 3A
PRIOR ART
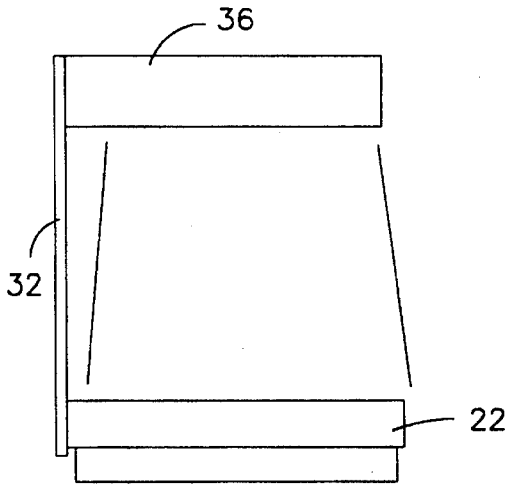
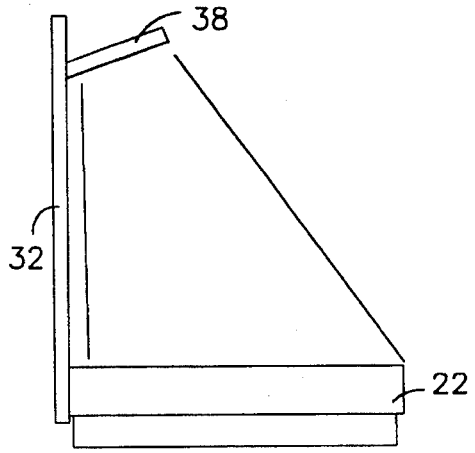
FIG. 3B
FIG. 4
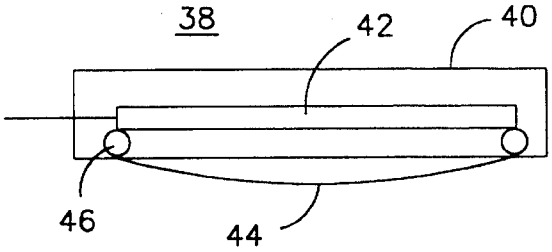
FIG. 5
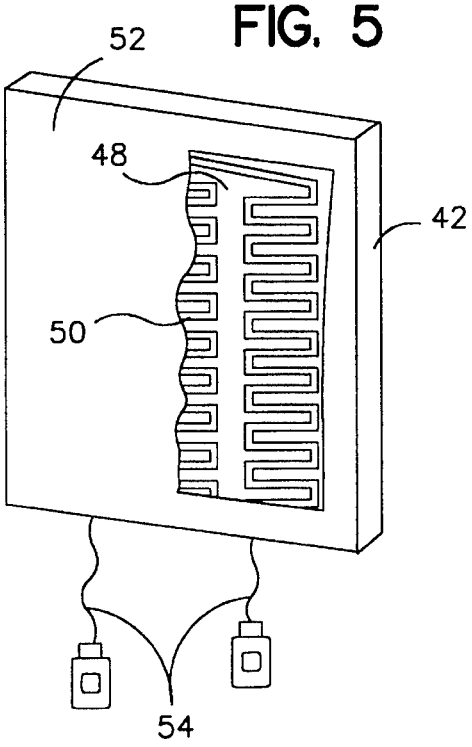

FIG. 6
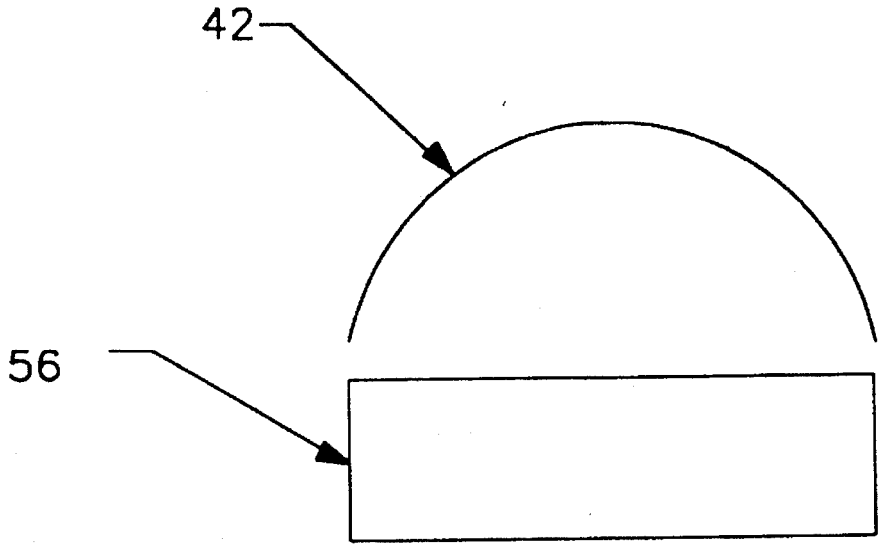
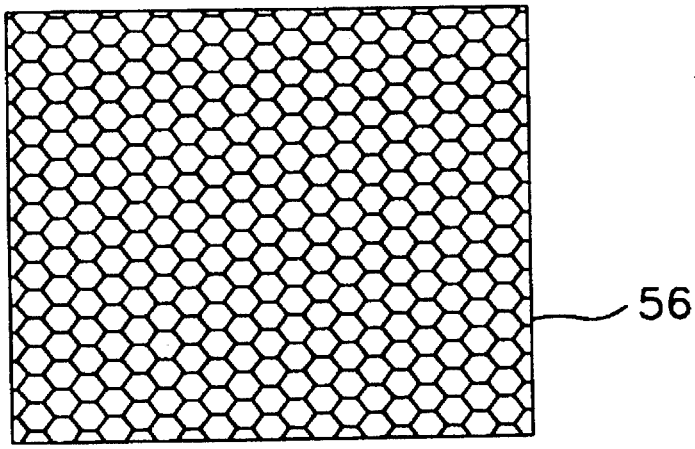
FIG. 7

HEATER ASSEMBLY FOR INFANT WARMERS

BACKGROUND OF THE INVENTION

The present invention relates to infant care centers of the type that provide a support or bed for the infant as well as including an overhead heating unit that directs heat toward the infant for heating that infant.

In such infant care centers one common type of heater that is used is generally of a radiant type including one or more Calrod heaters that are positioned above the infant. Typically, the Calrod heaters are high resistance materials that are relatively long and the Calrod resistance unit itself is generally encased in a glass protective tube that may be in the order of one-half inch in diameter.

Such infant care heaters also require a reflector since the heat needs to be directed toward the infant and the Calrod heater emits infrared radiation in a full 360 degrees around its cylindrical length, as well as at its ends. The typical reflector is a metallic reflector that encloses the upper surface of the Calrod unit and is formed in the shape of a parabola to direct the radiation downwardly toward the infant. Such reflectors are cumbersome, and need considerable support in order to be retained in a sturdy position above the infant. Too, the glass protective tube surrounding the Calrod resistance heater also requires protection to prevent breakage since, obviously, the breakage of glass could cause harm to the patient or surrounding personnel.

Current Calrod type infant heaters are therefore relatively cumbersome and large and tend to be positioned at a focus point that directly interferes with the vision of the personnel attending to the infant or create a physical obstruction to such personnel.

Accordingly, the heater units are generally difficult to work around and, at times, must be moved out of the way when personnel are attending to the infant such as when X-rays are being taken of the infant. In all, the Calrod heaters create considerable inconvenience to the personnel attending to an infant.

Additionally, there are various other problems associated with such Calrod resistance heaters, since they are relatively slow in response time due to the thermal mass being fairly high and therefore the units are slow to respond to changes in heating made by the user. Part of the high thermal mass is contributed by the frame and other structural members that maintain the Calrod heating unit in its position.

There is additionally a problem in arranging the Calrod units such that the overall distribution of heat is uniform and focused to create the proper footprint on the infant support with good efficiency. The infrared radiation emitted at the ends of the Calrod heater is particularly difficult to control since it heats up the support materials but provides very little benefit in the form of heat to the infant.

As a difficulty, therefore, the heater, while needed to provide the heating to the infant is generally in the way of the attending personnel and such personnel are inconvenienced by the heater, especially so in the case where x-rays are being taken of the infant and the conventional Calrod type heater must be physically moved aside to properly position the X-ray machine. Additionally, the control of the Calrod heater is difficult due to the high thermal mass of the Calrod heater with its attendant reflector, frame, protective shield and supporting structure.

SUMMARY OF THE INVENTION

The infant care center of the present invention includes a heater assembly that overcomes the foregoing problems and which employs a unique infrared emitter for the present application, that is, the heating of infants.

The infrared emitter emits only radiation having wavelengths in the IR spectrum. Such emitters are conventionally used with heating applications such as household toasters and comprise an emitting foil mounted or adhered to a ceramic plate and one commercial supplier is Thermal Circuits, Inc., 4 Jefferson Avenue, Salem Mass. 01970-2976.

As such, the infrared emitter is uniquely suitable for the heating of infants in an infant care center since a unit needed for such application can be relatively small, i.e. 6×8 inches and therefore takes up considerable less space above the infant than the conventional Calrod heaters with the attendant parabolic reflector, mounting structure and the like. Thus, the attending personnel need not move the emitter aside when working on the infant and the emitter can continue to provide infrared radiation throughout the time the personnel are in attendance, even during the times that x-rays are being taken of the infant.

The infrared emitters are instantaneous on and off control and therefore not only respond quickly but are very advantageous when utilized with some automatic control, such as proportional control, since the response time to the control is instantaneous. In the current Calrod heaters, for example, the unit could take in the order of three minutes to heat up and/or change temperature at the response of some controller.

Since such infrared emitters have very little thermal mass, they are quick to respond to changes in heating desired by the user and the unit quickly responds. The infrared emitters, being ceramic, do not require a glass or other enclosure and can be used with conventional lenses to provide an even distribution of heat over the infant platform at any desired footprint. Thus, the efficiency of heating the infant is enhanced since all of the radiation of the infrared emitters is directed downwardly in a well directed footprint toward the infant platform, thus, no reflector is even required since none of the radiation is directed upwardly.

Due to the relatively small size of such infrared emitters to provide the equivalent heat of a Calrod heater, the infrared emitter need not be moved out of the way for the attending personnel to take x-rays of the infant or to gain any normal access to the infant, therefore, control is enhanced and the convenience to the user improved.

BRIEF DESCRIPTION OF THE DRAWINGS

FIG. 3A and 3B are side schematic views showing, respectively, a conventional heater in an infant care center and an infrared emitter used with an infant care center in accordance with the present invention;

FIG. 4 is a schematic view of an infrared emitter assembly used with the present invention;

FIG. 5 is an isometric view, partially cutaway, of an infrared emitter used with the present invention;

FIG. 6 is a side view, partially broken away, of a specific embodiment of the present invention; and FIG. 7 is bottom view of the embodiment of FIG. 6.

DESCRIPTION OF THE PREFERRED EMBODIMENT

Figure 1:
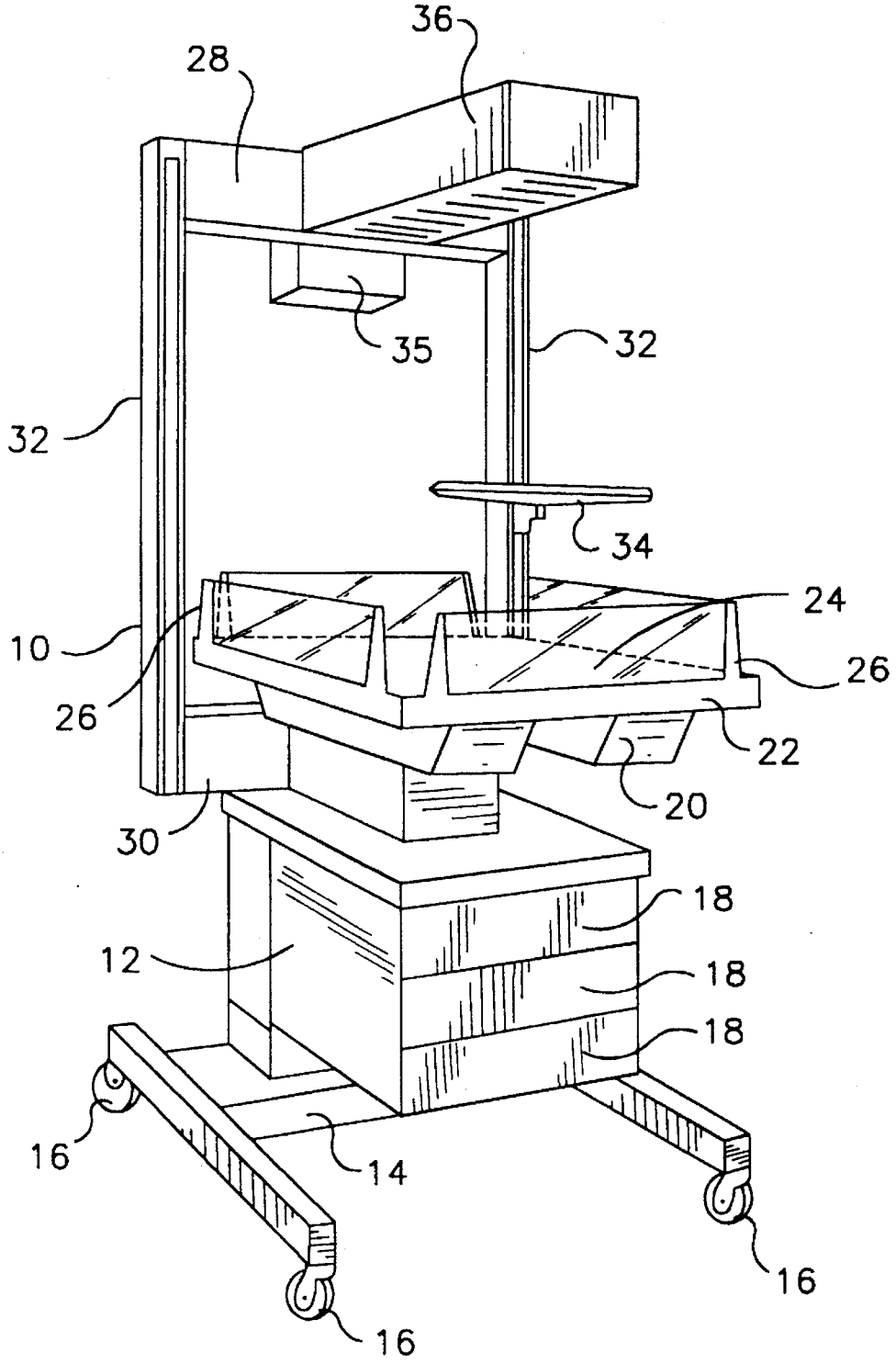
FIG. 1 PRIOR ART
FIG. 1 is an isometric view of an infant care center having a conventional heater.

Referring now to FIG. 1, there is shown an isometric view of an infant care center having a conventional heater mechanism. As shown, the care center includes a frame 10 which provides a free standing unit for the infant care center. The frame 10 is supported upon a cabinet 12 which, in turn, is mounted upon a base 14 having wheels 16 so that the care center is easily movable. The cabinet 12 may also include one or more drawers 18 for containing items for attending to the infant.

An infant pedestal 20 is mounted atop of the cabinet 12 and on which is located an infant bed 22 which underlies an infant positioned thereon. Pedestal 20 is the main support for infant bed 20. The infant bed 22 has a generally planar upper surface 24 with appropriate cushioning material for comfort of the infant and further may be surrounded by guards 26, generally of a clear plastic material, and which contain the infant on the upper surface 24. Generally, the guards 26 are removable and/or releasable for complete access to the infant.

Frame 10 includes upper and lower cross members 28 and 30, respectively, joining a pair of vertical struts 32 and which vertical struts 32 may provide a means of support for other structural parts such as a shelf 34.

Mounted on the upper cross member 28 may be a control module 35 for containing the various electrical controls to operate the care center. In addition, a heater 36 is mounted to the upper cross member 28. As will be noted, the location of the heater 36 is such to be above the infant bed 22. The heater is focused so as to provide a footprint on and around the infant to optimize the amount of heat directed upon the infant. Various types of focusable heaters are available for such application, examples of which may be a Calrod focused heater of about 500–600 watts, or a corrugated foil heater. Preferably, the latter is of a linear length such that the footprint of heat at the infant bed 22 is generally rectangular.

Typically, the heater 36 is about 18 to 24 inches in length extending outwardly, cantilever fashion from the cross member 28 and will contain therein, the Calrod resistance heater that is enclosed within a glass tube. Also within the heater 36 is a parabolic metal reflector that redirects the infrared radiation emanating in all directions from the Calrod resistance heater downwardly towards the infant bed 22. The parabolic reflector and Calrod heater are not shown but are conventional in such currently available infant care centers.

Figure 2:
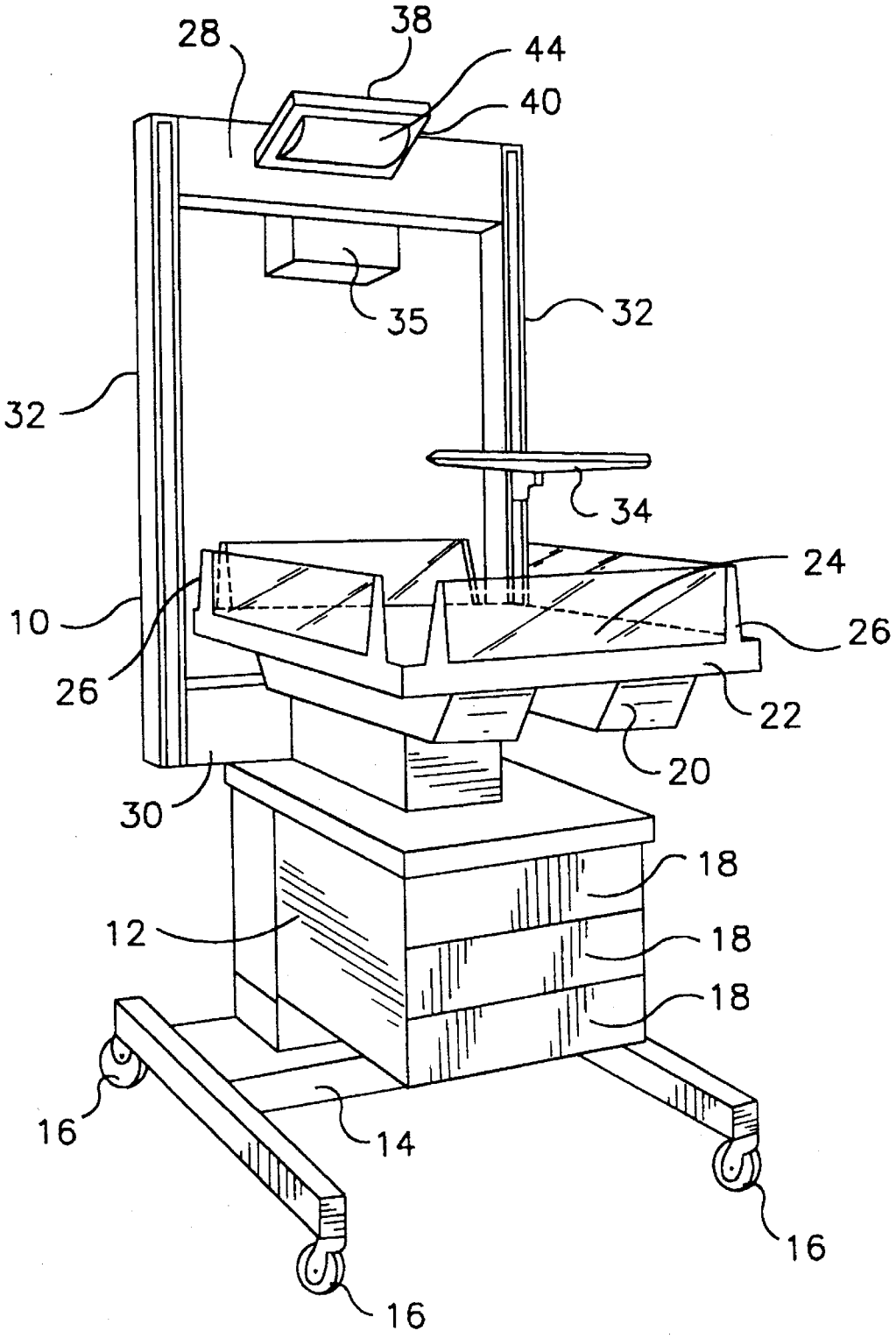
FIG. 2 is an isometric view of an infant care center having an infrared emitter in accordance with the present invention.

Turning now to FIG. 2, there is shown an isometric view of an infant care center in which the conventional Calrod heater of FIG. 1 has been replaced with an infrared emitter assembly 38 in accordance with the present invention. The infrared emitter assembly 38 comprises a frame 40 within which is mounted the infrared emitter 42 (FIG. 5) and a lens system including a lens 44 is provided to focus the emitted infrared radiation to the desired footprint upon the upper planar surface 24 of the infant bed 22 to provide the heat to the infant placed thereupon.

The typical dimensions for the emitter assembly 38 may be approximately 6×8 inches to provide sufficient heat to the infant basically comparable to the prior art Calrod type heaters. Again, the control of the emission of the infrared emitter is conventional and may be an on-off manual control or various automatic control programs such as proportional control and the like.

As can be seen in FIG. 2, the infrared emitter assembly 38 is considerable smaller and less obtrusive that the conventional Calrod type of heater 36 as shown in FIG. 1. In addition, as outlined, the infrared emitter assembly 38 is of sturdy construction and is not subject to breakage. Control is nearly instantaneous and the infrared radiation can, therefore, be controlled precisely and by use of a relatively simple lens, all of the radiation can be directed toward the infant and is therefore usable. No radiation is emitted from the ends or sides of the infrared emitter assembly 38 or directed upwardly so as to require a reflector to redirect that radiation back toward the infant.

The convenience of the size of the infrared emitter assembly 38 is shown in the FIGS. 3A and 3B wherein both figures are side schematic views, FIG. 3A being a view of the conventional prior art heater using high resistance heaters such as Calrod heaters and FIG. 3B shows the infrared emitter assembly 38 of the present invention.

In FIG. 3A, then heater 38 takes up most of the space above the infant bed 22 and, as explained, is therefore fairly cumbersome and difficult to work around. The FIG. 3B infant care center, on the other hand, with the same infant bed 22 with the same dimensions, has the infrared emitter assembly 38 that takes up very little space above the infant bed 22 and thus is convenient for the attending personnel and does not impair or block the working area for such personnel. In both cases, however, the footprint of the radiation directed toward the infant bed 22 is similar, however, the radiation emitted from the infrared emitter assembly is better defined and focusable upon the infant bed 22.

Taking next, FIG. 4, there is shown a schematic view of an infrared emitter assembly 38 constructed in accordance with the present invention. In FIG. 4, the infrared emitter 42 is shown enclosed within the frame 40 which surrounds and protects the infrared emitter 42. In contrast to the Calrod type of heaters, however, the frame 40 need not be heavy so as to bear any considerable weight as the infrared emitter 42 itself is in the range of a few ounces and therefor the frame can be extremely light. In addition, since the radiation of the infrared emitter 42 is directed only downward toward the infant, the frame 40 is not subject to heating, nor does it need a reflector to redirect any radiation that would otherwise be directed away from the infant.

A lens 44 focuses and shaped the infrared radiation emitted from the infrared emitter 42 and lens system including a lens 44 may be fairly conventional and constructed of quartz or glass that will readily allow radiation having a spectrum of wavelengths in the infrared range through the material. A gasket 46 is included to seal the lens 44 within the frame 40 so as to make a dust tight seal and maintain the infrared emitter assembly 38 relatively free from the introduction of dirt or other contaminants.

Turning next to FIG. 5, there is shown, an infrared emitter 42 for use with the subject invention. As stated, such emitters are available commercially from various sources, one of which is Thermal Circuits, Inc. of 4 Jefferson Avenue, Salem, Mass. 01970-2976. Generally the infrared emitter 42 is comprised of a ceramic body 48 on to which is placed an etched foil 50, comprised of a material such as copper in a desired pattern. Covering the etched foil 50 is a thermal insulator 52 that protects the etched foil 50 and seals the surface from which the infrared radiation is emitted.

Electrical wires 54 are provided for connection to a source of electrical energy to power the infrared emitter 42. As may be seen, therefore in FIG. 5, typical dimensions for an infrared emitter 42 suitable for heating an infant in an infant care center would be about ¼ inches in thickness and overall dimensions of 6×8 inches. Typically, infrared emitters of the size and dimension suitable for the infant care center are produced commercially for applications such as household or commercial toasters.

In the further embodiment of FIGS. 6 and 7, there is shown a side view, partially cutaway, and a bottom view, respectively of a specific embodiment of the subject invention. In this embodiment the infrared emitter 42 is shaped into an arcuate shape, preferably parabolic, to direct the infrared radiation into a desired pattern toward the infant. Affixed to the infrared heater 42 is a honeycomb 56 and which redirects that infrared radiation downwardly toward the infant. Preferably the honeycomb 56 is a stainless steel foil comprising multiple hexagonal passageways of about 1 to 2 inches in length and having parallel flat surfaces of the hexagonal shapes about ¼ inches apart. The honeycomb 56 redirects the infrared radiation from the infrared emitter 42 into a fairly straight pattern toward the infant.

Typical honeycomb material suitable for this application is available commercially through Kentucky Metals, Inc of New Albany, Ind. in a wide variety of sizes and thicknesses.

While the present invention has been set forth in terms of a specific embodiment, it will be understood that the infant care center herein disclosed may be modified or altered by those skilled in the art to other configurations. Accordingly, the invention is to be broadly construed and limited only by the scope and spirit of the claims appended hereto.

I claim:

1. An infant care center comprising:

a standing frame member;

a generally planar infant bed affixed to said standing frame member and adapted to underlie an infant;

an infrared emitter mounted to said standing frame member above said infant bed, said infrared emitter comprising a ceramic base and having an emitting foil affixed thereto and adapted to radiate infrared electromagnetic radiation; and a lens system located intermediate said infrared emitter and said infant bed, said lens system receiving the infrared radiation emitted from said emitter and focusing the radiation passing through said lens system to a predetermined footprint on said infant bed to warm an infant positioned on said infant bed.

2. An infant care center as defined in claim 1 further including an emitter frame affixed to said standing frame member wherein said infrared emitter is enclosed within said emitter frame, and wherein said lens system comprises a lens affixed to said frame to enclose said emitter within said emitter frame in a dust tight atmosphere.

3. An infant care center as defined in claim 2 wherein said emitter frame has a downwardly facing opening having an outer peripheral edge, and said lens assembly further includes an O-ring interposed between said lens and said outer peripheral edge of said emitter frame to seal said lens to said emitter frame by means of said O-ring.

4. An infant care center comprising:

a standing frame member;

a generally planar infant bed affixed to said standing frame member and adapted to underlie an infant;

an infrared emitter assembly mounted to said standing frame member above said infant bed, said infrared emitter assembly comprising an infrared emitter having a ceramic base and having an emitting foil affixed thereto, said infrared emitter formed into an arcuate shape to direct infrared electromagnetic radiation toward said infant bed; and a radiation shaping member located intermediate said infrared emitter and said infant bed, comprised of a plurality of elongated openings adapted to receive the infrared radiation from said arcuate shaped infrared emitter and to redirect such infrared radiation into a desired pattern toward the infant bed.

5. An infant care center as defined in claim 4 wherein said arcuate shape is a parabolic shape.

6. An infant care center as defined in claim 4 wherein said radiation shaping member comprises a honeycomb member having a plurality of hexagonal openings.

7. An infant care center as defined in claim 4 wherein said radiation shaping member is comprised of a material providing elongated openings having a thickness of between about 1 to 2 inches.

8. A method of providing heat to an infant positioned upon an infant bed comprising the steps of:

locating an infrared emitter adapted to emit substantially all infrared radiation above the infant bed;

causing the infrared emitter to emit substantially all of its infrared radiation in a path generally toward the infant bed; and modifying the path of the infrared radiation emitted by the infrared emitter by locating a radiation shaping member intermediate the infrared emitter and the infant bed having a plurality of elongated pathways through which the radiation passes to create a predetermined footprint of radiation reaching the infant bed to warm the infant.

9. A method of providing heat to an infant as defined in claim 8 wherein said elongated pathways are hexagonal shaped.

* * * * *